US005737852A

United States Patent [19]

Shukla et al.

[11] Patent Number: 5,737,852

[45] Date of Patent: Apr. 14, 1998

[54] DRYNESS CONTROL FOR CLOTHES DRYER

[75] Inventors: Sanjay P. Shukla, Hilliard, Ohio; Sean F. Myers, Webster City; William B. Hughett, Fort Dodge, both of Iowa

[73] Assignee: White Consolidated Industries, Inc., Cleveland, Ohio

[21] Appl. No.: 692,439

[22] Filed: Aug. 5, 1996

[51] Int. Cl.[6] ..... C26B 13/10

[52] U.S. Cl. ..... 34/528; 34/531; 34/562; 318/483; 307/650; 307/651

[58] Field of Search ..... 34/523, 524, 528, 34/531, 562, 563, 564, 532, 533, 550; 318/483; 307/650, 651, 652

[56] References Cited

U.S. PATENT DOCUMENTS

| | | | |
|---|---|---|---|
| 3,122,426 | 2/1964 | Horecky | 34/531 |
| 3,271,876 | 9/1966 | Behrens | 34/531 |
| 3,271,878 | 9/1966 | Martin | 34/531 |
| 3,331,139 | 7/1967 | Finnegan et al. | 34/531 |
| 3,521,377 | 7/1970 | Niewyk et al. | 34/563 |
| 3,599,342 | 8/1971 | Cotton | 34/531 |
| 3,621,293 | 11/1971 | Heidtmann | 327/428 |
| 3,651,579 | 3/1972 | Smith | 34/531 |
| 3,710,138 | 1/1973 | Cotton | 307/118 |
| 3,758,959 | 9/1973 | Karklys | 34/533 |
| 3,765,100 | 10/1973 | Heidtmann | 34/533 |
| 3,782,001 | 1/1974 | Cotton | 34/531 |
| 3,818,603 | 6/1974 | Marcade | 34/532 |
| 3,822,482 | 7/1974 | Cotton | 34/528 |
| 3,864,844 | 2/1975 | Heidtmann | 34/531 |
| 4,215,486 | 8/1980 | Heyer et al. | 34/531 |
| 4,312,138 | 1/1982 | Ellington | 34/531 |
| 4,385,451 | 5/1983 | Wesley | 34/563 |
| 4,385,452 | 5/1983 | Deschaaf et al. | 34/562 |
| 4,422,247 | 12/1983 | Deschaaf | 34/550 |
| 4,470,204 | 9/1984 | Wesley | 34/550 |
| 4,477,982 | 10/1984 | Cotton | 34/550 |
| 4,738,034 | 4/1988 | Muramatsu et al. | 34/524 |
| 5,367,265 | 11/1994 | Gaudette | 307/650 |

*Primary Examiner*—John M. Sollecito
*Assistant Examiner*—Steve Gravini
*Attorney, Agent, or Firm*—Pearne, Gordon, McCoy & Granger LLP

[57] ABSTRACT

A dryness control circuit for a household clothes dryer including a power supply circuit and a moisture sensing circuit. The power supply circuit converts high voltage AC power into low voltage, DC power. The low voltage, DC power is supplied to the moisture sensing circuit. The moisture sensing circuit includes a moisture sensor having a pair of spaced-apart electrodes, a time delay circuit, an electrostatic discharge attenuation circuit, and a motor controller circuit. The motor controller circuit includes a control hysteresis or dead-band in which operation of a timer motor is unaffected. The time delay circuit includes an RC network which slowly charges and discharges to prevent erroneous dryness or moisture readings, which are sensed by the moisture sensor, from causing the motor controller circuit to improperly actuate or deactuate the timer motor. The electrostatic discharge attenuation circuit negates the deleterious effects of static build up. The time delay and control hysteresis of the moisture control circuit cooperate to prevent false actuation or deactuation of the timer motor.

4 Claims, 1 Drawing Sheet

DRYNESS CONTROL FOR CLOTHES DRYER

BACKGROUND OF THE INVENTION

1. Field of the Invention

The present invention relates to dryness or moisture control circuits for household clothes dryers.

2. Description of Related Art

As clothes dryers have developed, there has been increasing emphasis on automatic controls and, more specifically, on controls that will automatically determine when the load of the clothes has reached a predetermined dryness condition and thereafter end the drying cycle. Several patents, to be discussed hereafter and expressly incorporated herein by reference, relate to dryness sensing and clothes dryer control circuits, and illustrate the development pattern of these automatic clothes dryer control systems.

U.S. Pat. No. 4,312,138 discloses a control circuit wherein the voltage developed across the clothes, which is related to the wetness thereof, is used to charge a capacitor. The voltage across the capacitor is also developed across a neon lamp and, when the voltage reaches the ignition potential of the lamp, the capacitor discharges through the lamp and the heated drying cycle of the clothes dryer terminates. See also, U.S. Pat. Nos. 3,782,001; 3,710,138; 3,651,579; 3,599,342; and 3,521,377.

U.S. Pat. No. 3,271,878 discloses an automatic moisture sensing circuit wherein DC voltage is applied to sensing rings. As the clothes dry, a capacitor $C_3$ is charged and, when the capacitor voltage equals a predetermined voltage, the capacitor discharges through a neon lamp which allows a second capacitor $C_2$ to charge. When the voltage across the capacitor $C_3$ drops below the ignition potential of the lamp, the lamp turns off. The neon lamp is thereby periodically rendered conductive until the second capacitor is sufficiently charged to trigger a thyratron which completes a circuit through a relay to de-energize the heater and motor. See also, U.S. Pat. No. 3,271,876.

U.S. Pat. No. 3,758,959 discloses a sensor control which uses a cascade of transistors to control a triac which, in turn, controls dryer functions. The '959 patent also discloses a circuit to reject electrostatic charge developed across the sensors.

U.S. Pat. No. 4,215,486 discloses a dryer control wherein the resistance across the clothes determines the duty cycle or frequency of a pulse signal. A filter has an output which is proportional to the duty cycle or frequency of the pulse signal. The filter output is compared to a reference signal to control dryer operation.

U.S. Pat. No. 4,385,451 shows a sensor control which compares the sensed voltage across the clothes to a reference voltage. When the sensed voltage across the clothes exceeds the reference voltage for a period of time, it is determined that the clothes are dry and an output switch connected to a timer is closed to allow the cycle to run out. The '451 patent includes circuitry to limit the effects of static discharge. See also, U.S. Pat. No. 4,470,204.

U.S. Pat. No. 4,477,982 shows a fabric dryness sensing circuit which distinguishes between wet fabrics and metallic objects, such as buttons. The circuit senses wet clothes and, when less than a predetermined number of "wet clothes" sensor hits are determined within a certain time period, the clothes are determined to be dry.

U.S. Pat. No. 4,327,502 senses voltage across the clothing which is amplified and used to charge a capacitor. Voltage across the capacitor is isolated from sensed voltage by the amplifier and is compared to a reference voltage. When the capacitor voltage falls below a certain level, a timer is run. As the clothes dry, the timer runs more frequently and for longer periods of time until it times out.

Despite the progress in the art, as evidenced by the foregoing patents, there exists a need in the art for a simple, reliable, and inexpensive control circuit for a household clothes dryer. There also exists a need in the art for a control circuit which is responsive to sensed moisture conditions of the clothes being dried, and which is useful in conjunction with conventional mechanical timers.

SUMMARY OF THE INVENTION

The present invention provides an improved control circuit for a household clothes dryer which controls the operation of a conventional mechanical timer. In accordance with the present invention, the control circuit includes a power supply circuit and a moisture sensor circuit which are operable to power the mechanical timer when the clothes have reached a predetermined level of dryness.

In further accordance with the present invention, the moisture control circuit takes advantage of a time delay circuit and control hysteresis to provide improved operational and control characteristics. The time delay and control hysteresis prevent false readings of moisture or dryness, which result from intermittent contact of the sensors with the clothes or from conductive objects in the dryer drum contacting the sensors, from affecting the operation of the timer motor.

In further accordance with the present invention, the moisture sensor circuit includes a commercially available 555-type integrated circuit, which will hereafter be referred to as the timer motor controller. When a voltage input to the timer motor controller is indicative of moist clothes, the mechanical timer is deactivated. When the input voltage to the timer motor controller is indicative of dry clothes, the timer motor is activated. The voltage input indicative of wet clothes is different than the voltage input indicative of dry clothes, resulting in a control hysteresis which helps to prevent undesirable repeated cycling of the timer motor on and off.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

The present invention, to be described hereafter, is directed toward an improved control circuit for a household clothes dryer (not shown). The general construction of household clothes dryers are well known in the art and will not be discussed herein.

Figure 1:
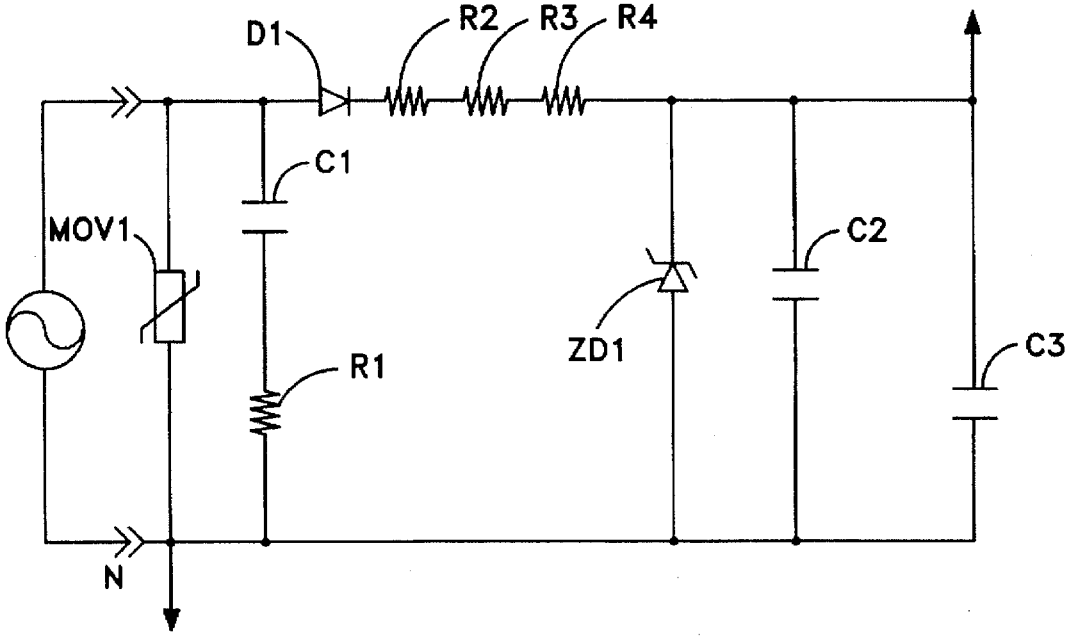
FIG. 1 is a schematic illustration of a power supply circuit according to the present invention; and, FIG. 2 is a schematic illustration of a moisture control circuit according to the present invention.

A power supply circuit according to the present invention is shown in FIG. 1, and includes a plurality of resistors R1, R2, R3, R4, a diode D1, a plurality of capacitors C1, C2, C3, a zener diode ZD1, and a varistor MOV1. The diode D1 and resistors R2, R3, and R4 provide half-wave rectification and voltage reduction, and convert a high voltage AC input into a lower voltage, unfiltered DC signal. As will be recognized by one skilled in the art, the diode D1 serves as a half-wave rectifier and the resistors R2, R3, R4 serve as a voltage divider, and reduce the voltage of the rectified DC signal.

The resistors R2, R3, R4 may, naturally, be replaced by as single resistor. However, a plurality of resistors is preferred to keep the individual resistor's power rating lower, and to reduce the negative effects of resistor failure. Hence, using a plurality of resistors R2, R3, R4 reduces the cost of the power supply circuit and provides more reliable operation than would a power supply circuit which replaces the resistors R2, R3, R4 with a single resistor.

The zener diode ZD1 provides voltage regulation. The capacitor C2 rejects or filters reduces ripple voltage. The capacitor C3 rejects or filters high frequency noise. The varistor MOV1 protects the circuits from high energy voltage surges. The resistor R1 and capacitor C1 provide noise immunity from electrically fast transients present on the line from switching of motors resulting, in part, from heavy loads.

In a power supply circuit according to the present invention, the following component values or designations have been used successfully: R1 51Ω, 0.25 W; R2 820Ω, 2.00 W; R3 820 Ω, 2.00 W; R4 820Ω, 2.00 W; C1 0.068 μF; C2 470.000 μF, 35V; C3 0.100 μF; MOV1 150V, 40J; D1 1N4004; ZD1 1N5242B, 0.5 W.

Figure 2:
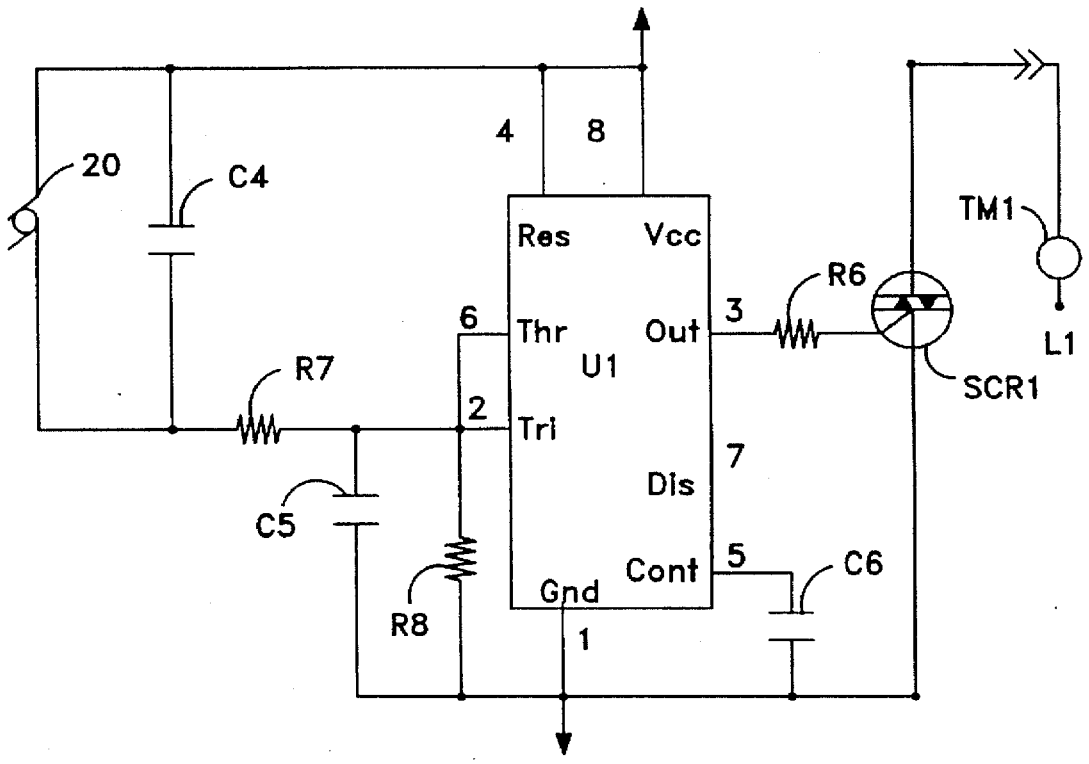

The moisture sensor circuit, shown in FIG. 2, includes a 555-type integrated circuit U1 (hereafter referred to as the timer motor controller U1), a plurality of resistors R6, R7, R8, a plurality of capacitors C4, C5, C6, a pair of contact moisture sensors 20, a triac SCR1, and a timer motor TM1. The timer motor controller U1, resistor R6, and triac SCR1 define a timer motor control circuit.

In a moisture sensor circuit according to the present invention, the following component values or designations have been used successfully: R6 1kΩ, 0.25 W; R7 5kΩ, 0.25 W; R8 20kΩ, 0.25 W; C4 0.001 μF; C5 10.000 μF, 25V; C6 0.100 μF; U1 LM555; SCR1 MAC97/97A.

The timer motor controller U1 functions generally as a comparator, and outputs a voltage signal at pin 3, either high or low, dependent upon the voltage applied at an input (pin 6) as compared to a reference voltage supplied from the power supply circuit (FIG. 1) and applied at pin 8. Generally, when the input voltage at pin 6 of the timer motor controller U1 is high as compared to the reference voltage at pin 8, the output at pin 3 is low, and the triac SCR1 is turned off. Keeping the triac SCR1 off disconnects the timer motor, and prevents the timer from counting down toward the end of the drying cycle.

When the input voltage at pin 6 of the timer motor controller U1 is low as compared to the reference voltage applied at pin 8, the output at pin 3 is high, and the triac SCR1 is turned on. Turning on the triac SCR1 activates the timer motor, and permits the timer to count down toward the end of the drying cycle.

The difference between the "low voltage" and the "high voltage" at pin 6 of the timer motor controller U1 is a control hysteresis or dead band and is useful in preventing repeated cycling of the timer motor on and off, as will be apparent from the discussion to follow. In the illustrated and preferred embodiment, "high voltage" is greater than or equal to two-thirds of the reference voltage, "low voltage" is less than or equal to one-third of the reference voltage, and the dead band or control hysteresis is between one-third and two-thirds of the reference voltage.

As the clothes are tumbled in the dryer drum (not shown) they randomly contact the spaced-apart electrodes of the stationary moisture sensor 20. Hence, the clothes are intermittently in contact with the sensor electrodes. The duration of contact between the clothes and the sensor electrodes is dependent upon a number of factors, such as the wetness of the clothes, the type of clothes, and the amount or volume of clothes in the drum.

When wet clothes are in the dryer drum and in contact with the sensor electrodes, the resistance across the sensor is low. Otherwise, when the wet clothes are not contacting the sensor electrodes, the resistance across the sensor is very high (open circuit), which is falsely indicative of a dry load.

On the other hand, when the clothes are dry and contacting the sensor electrodes, the resistance across the sensor is high and indicative of a dry load. If a conductive portion of the dry clothes, such as a metallic button or zipper, contacts the sensor electrodes, the resistance across the sensor is low, which is falsely indicative of a wet load.

Hence, when the clothes are wet there are times when the sensor will sense a dry condition (high resistance) and, when the clothes are dry, there are random moments when the sensors will sense a wet condition (low resistance). The control hysteresis, and a time delay provided by the moisture control circuit, to be described hereafter, leads to a better, and more accurate, sensing of the dryness condition and resulting control of the dryer operation.

The resistor R8 and the capacitor C5 define a time delay circuit which delays operation of the control circuit by slowly changing the voltage at pin 6 of the timer motor controller U1. When the dryer is operated with a load of wet clothes, and the power supply circuit provides low voltage DC power to the moisture sensor circuit, the sensor electrodes 20 are in contact with wet clothes (low resistance) and the capacitor C5 slowly charges up to a high voltage, which provides high voltage at pin 6 of the timer motor controller U1 and keeps the timer motor turned off, as discussed previously. During periods of operation when the wet clothes are not in contact with the sensor electrodes 20, the capacitor C5 slowly discharges through the resistor R8. A small trickle current through capacitor C4 slows the discharge of the capacitor C5. Since the wet clothes will again come in contact with the sensors 20, the voltage at pin 6 of the timer motor controller will not drop to the "low voltage" level at which point the time motor will be activated. Hence, the control hysteresis or dead band and time delay cooperate to prevent false dryness sensing, and resulting timer motor cycling.

As the clothes drying cycle proceeds the clothes become dryer. When dryer clothes come in contact with the sensor electrodes, the resistance across the electrodes increases, and the capacitor C5 begins to discharge through the resistor R8. At a desired level of dryness, the capacitor C5 has discharged through R8 to the point that the voltage at pin 6 of the timer motor controller U1 is low, and the timer motor is turned on, as described hereinbefore.

During this period, conductive objects within the dryer drum may come into contact with the sensors, which would therefore sense a low resistance indicative of a wet load of clothes. However, due to the previously-mentioned control hysteresis and the time delay provided by the moisture sensing circuit, the voltage at pin 6 of the timer motor controller will not rise to the "high voltage" level, and the timer motor will not be turned off. This prevents false moisture-sensing, and resulting de-activation of the timer motor, during the advance of the timer toward the end of the drying cycle.

During operation of the clothes dryer it is common for electrostatic charges to build up, especially when synthetic materials, such as nylon and certain synthetic polyesters, are being dried. Since one of the sensor electrodes is connected to the low voltage DC power supplied by the power supply circuit, if an electrostatic charge is developed at the other sensor electrode connected to the resistor R7 there could be an undesirable electrostatic discharge through the moisture control circuit which may damage the circuitry, or give a false sensing of low resistance (wet clothing) which would prevent the dryer timer from advancing. Such a situation would result in, at best, requiring the user to manually terminate the drying cycle and, at worst, over-drying of the clothes, which may damage the clothing.

However, in the moisture control circuit of the present invention, the capacitor C4 prevents discharge of any built-up electrostatic charges. Therefore, the deleterious effects of electrostatic charges, are avoided.

While the preferred embodiment of the present invention is shown and described herein, it is to be understood that the same is not so limited but shall cover and include any and all modifications thereof which fall within the purview of the invention.

What is claimed is:

1. A control circuit for a household clothes dryer timer motor, comprising:

a power supply circuit electrically connected to high voltage AC power and operable to convert the high voltage AC power into low voltage DC power;

a moisture sensing circuit electrically connected to the power supply circuit and including a moisture sensor having pair of electrodes, a time delay circuit, a timer motor controller, wherein said moisture sensor supplies a voltage signal to said time delay circuit indicative of sensed dryness, an output of said time delay circuit is electrically connected to an input of said timer motor controller and said time delay circuit serves as a filter to prevent transient spikes in the sensed dryness signal from affection operation of said timer motor controller, and an output of said timer motor controller is electrically connected to a timer motor, wherein, when the voltage applied at the timer motor controller input is a first value the timer motor is turned off and, when the voltage applied at the timer motor controller input is a second value the timer motor is activated, said first value being different than said second value.

2. A control circuit according to claim 1, wherein there is a dead band between said first value and said second value in which the operation of the timer motor is unchanged.

3. A control circuit for a household clothes dryer timer motor, comprising:

a power supply circuit electrically connected to high voltage AC power and operable to convert the high voltage AC power into low voltage DC power;

a moisture sensing circuit electrically connected to the power supply circuit and including a moisture sensor having pair of electrodes, a time delay circuit, a timer motor controller, and an electrostatic discharge protection circuit which prevents discharge of electrostatic charges developed at said electrodes through said moisture sensing circuit, wherein said timer motor controller has an input electrically connected to the time delay circuit and an output electrically connected to a timer motor, the moisture sensor supplies a sensed dryness signal to the time delay circuit, an output of said time delay circuit is supplied to an input of said timer motor controller and the time delay circuit serves as a filter to prevent transient spikes in the sensed dryness signal from affecting operation of said timer motor controller and, wherein, when the voltage applied at the timer motor controller input is a first value the timer motor is turned off and, when the voltage applied at the timer motor controller input is a second value the timer motor is activated, said first value being different than said second value.

4. A control circuit according to claim 3, wherein there is a dead band between said first value and said second value in which the operation of the timer motor is unchanged.

* * * * *

UNITED STATES PATENT AND TRADEMARK OFFICE

CERTIFICATE OF CORRECTION

PATENT NO. : 5,737,852

DATED : April 14, 1998

INVENTOR(S) : Shukla et al.

It is certified that error appears in the above-identified patent and that said Letters Patent is hereby corrected as shown below:

In Claim 1, Line 37, delete "affection" and insert --affecting--.

Signed and Sealed this

Twenty-fifth Day of August, 1998

Bruce Lehman

*Attest:*

BRUCE LEHMAN

*Attesting Officer*

*Commissioner of Patents and Trademarks*